United States Patent [19]

Schmitt

[11] Patent Number: 4,582,283

[45] Date of Patent: Apr. 15, 1986

[54] DISPLAY STAND MADE OF FOLDING MATERIAL

[75] Inventor: Paul Schmitt, Lauterbach, Fed. Rep. of Germany

[73] Assignee: Gustav Stabernack GmbH, Fed. Rep. of Germany

[21] Appl. No.: 642,239

[22] Filed: Aug. 17, 1984

[30] Foreign Application Priority Data

Aug. 20, 1983 [DE] Fed. Rep. of Germany ... 8323978[U]

[51] Int. Cl.[4] ..... A47F 1/00

[52] U.S. Cl. ..... 248/174; 206/44 R; 211/132

[58] Field of Search ..... 211/72, 73, 132; 248/174, 459; 206/44 R

[56] References Cited

U.S. PATENT DOCUMENTS

| | | | |
|---|---|---|---|
| 2,066,844 | 1/1937 | Lynch | 248/174 |
| 2,361,875 | 10/1944 | Sachs | 248/174 |
| 2,430,166 | 11/1947 | Fish et al. | 248/174 UX |
| 2,550,959 | 5/1951 | Bowman | 248/174 X |
| 2,713,984 | 7/1955 | Paige | 248/174 |
| 2,825,519 | 3/1958 | Potts et al. | 248/174 |
| 2,920,852 | 1/1960 | Hennessey | 248/174 |
| 3,164,350 | 1/1965 | Taub . | |
| 3,340,998 | 9/1967 | Wilson | 248/174 |

FOREIGN PATENT DOCUMENTS 2902573 1/1979 Fed. Rep. of Germany .

*Primary Examiner*—Robert W. Gibson, Jr.
*Assistant Examiner*—Sarah A. Lechok Eley
*Attorney, Agent, or Firm*—Robert D. Yeager; Christine R. Ethridge

[57] ABSTRACT

Display stand made of folding material having a tubular base with a counter fixed to the base for the reception and display of merchandise, the rear wall (3) of the base being extended upwards beyond the joint connecting the rear wall (3) to the top section (7), the side walls (2) likewise being extended at the rear to approximately the same height, at least one step (16,17) being formed in the side walls (2) and adjoining to the front, punched clearances (19) being formed in the bottom (12) of the counter (13) for the parts of the side walls (2) raised in steps to pass through, cuts matching one another being formed in the rear wall of the counter (13) and/or in the rearward extensions (8) of the side walls (2) of the base, a divider (21) being provided in the counter (13) ahead of each step (16,17) of the side walls (2) of the base, the ends of which divider are firmly connected to these side walls (14) of the counter, and blank strips being provided for those compartments of the counter (13) created by these dividers (21) and into which the steps (16,17) protrude from below, which blank strips can be inserted loosely from above into the compartment concerned and which rest on the upper edges of the steps (16,17) of the side walls (2) of the base when the display stand is assembled.

5 Claims, 5 Drawing Figures

DISPLAY STAND MADE OF FOLDING MATERIAL

BACKGROUND OF THE INVENTION

1. Field of the Invention

The invention relates to a display stand made of folding material having a tubular base, on the top of which there is a counter for the display and reception of merchandise.

2. Description of the Prior Art

Such display stands are also known as immediate displays and have proven successful in practice. A basic embodiment for such a display stand is described by German Offenlegungsschrift No. 2,902,573 by the applicant, FIGS. 8 and 9 therein. They have the quite considerable advantage for practical purposes that the base can be wrapped around the assembled, usually cuboid counter to a certain extent in a U-shaped or L-shaped manner to save space, so that the counter filled with the articles concerned can be shipped together with its base in a space saving way. At the point of sale, for example in a store, the display stand is then assembled by a few manipulations, in which the base need only be brought into its extended position, whereupon it is swung under the counter. The base is opened up automatically in this swinging proceedure because the distance between its front wall and rear wall is increased to the distance of the position for use in the aforementioned swinging operation.

Whereas, in the Offenlegungsschrift mentioned, the connection between the base and the counter is made by means of two separate adhesive flaps, the first European publication No. 54,884 describes a similar display stand in which the connection between the base and the counter is made by means of a top section which to a certain extent covers the front and rear wall of the base. The present invention can be used for all types of such display stands according to the publications mentioned as well as for similar display stands.

Common to both the aforementioned display stands is that the bottom of the counter is flat. The articles kept in the counter are therefore on the same level. However, for reasons of sale psychology, it is advantageous if the articles are displayed to the customer in a row rising from front to back.

In this context, the display stand according to U.S. Pat. No. 3,164,350 already proposes a serviceable solution as there the rear wall of the base and the adjoining section of the two side walls are extended upwards. Appropriate slits are provided in the bottom and in the rear wall of the associated counter, so that the counter can be mounted on top of the base in such a way that the extensions of the two side walls pass through the bottom of the counter and protrude to a certain extent inside the counter, in its rearward portion. A flat blank is then formed from above onto the protrusions thereby produced. Furthermore, the counter is subdivided into a rear and a front compartment by means of a blank bent in an L-shape when viewed from the side, the rearward dividing wall of which rests against the front edges of the extensions of the side walls.

The L-shaped blank is inserted in the counter loosely from above.

One disadvantage of this is that this know display stand is not designed as an immediate display.

This means that the erection of the display stand is relatively involved because, once the base has been assembled, the separate counter must be mounted on top of the base. Another disadvantage is that there is a danger that the L-shaped section could slip backwards during transit, in particular when there are only loosely packed articles in the counter. Such a displacement to the rear is possible during transit because the counter is separate from the base. During subsequent assembly, there is therefore the danger that the upper edges of the rear sections of the side walls of the base, which form the steps, could collide with the horizontal panel of the L section, so that the assembly operation cannot be carried out properly.

SUMMARY OF THE INVENTION

The invention avoids these disadvantages. It is based on the object of proposing a display stand which, whilst retaining the advantages of this so-called immediate display described at the start, permits the articles in the counter be displayed on several steps, it being intended that the steps are perfectly formed automatically in the assembly operation, i.e. without additional manipulations.

This object is achieved by the features of claim 1.

If the base is folded out of its flatly folded, outstretched position underneath the counter, the extensions of the side walls pass upwards through the abovementioned punched clearances in the bottom of the counter and form steps, together with the blank strips laid on the steps, in the compartments of the counter formed by the dividers. The articles in the counter are raised during this operation so that they are displayed to the viewer in a stepped arrangement rising from the front to the back. The assembly operation is performed automatically without any further action, partly because the ends of the dividers are fixed to the side walls of the counter and therefore cannot slip.

The number of steps is open to decision based on the particular circumstances, in particular the type and size of articles packed in the counter. At least one step must be provided and, in general, one or two such steps are sufficient. In principle, however, the number of steps is arbitrary.

Fixing the dividers to the counter, an important aspect of the invention, is preferably performed by designing the side walls of the counter as two-ply card walls, the dividers also being two-ply and having, at their ends, retaining flaps bent off at right angles to receive the side walls between the plies. The two-ply design of the side walls, including the rear wall and in some cases the front wall, of the counter can also be utilized for mounting advertising boards and the like in one or more corresponding slits in the rear wall of the counter.

BRIEF DESCRIPTION OF THE DRAWINGS

The invention will be described in more detail below with reference to an exemplary embodiment exhibiting further important features. The figures show a display stand according to the invention having three counter compartments, corresponding to three steps. Erection of the display stand with more or less compartments and steps is basically the same.

In the drawings.

DETAILED DESCRIPTION OF THE PREFERRED EMBODIMENT

Figure 1:
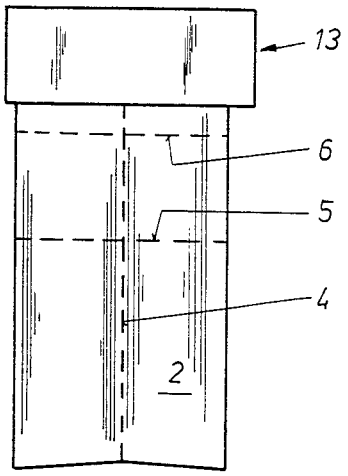
FIG. 1 shows a side view of a display stand according to the invention in the assembled state.

The base has a front wall 1, side walls 2 and a rear wall 3. Continuous longitudinal folding lines 4 are formed in the centre of the side walls from top to bottom. Furthermore, a lower transverse folding line 5, and above it an upper transverse folding line 6, are formed in all walls of the base. Emulating the two Offenlegungsschriften discussed at the start, the upper transverse folding line at 6 can in some cases by dispensed with, for it is only provided as a folding line for one of the adhesive flaps.

A top section 7 (see FIG. 3) is hinged at the front wall 1 and at the back wall 3. The folding lines provided for this purpose are located, in the case of the front wall, on the upper edge of the front wall and, in the case of the rear wall, preferably on the same level, that is to say at a distance 8 from the top edge of the rear wall. FIG. 1 shows that the counter of the display stand is arranged horizontally in the position for use; however, if the counter is to assume a position inclined slightly forwards, the distance 8 is reduced appropriately.

The top section 7 is subdivided into a front part 10 and a rear part 11 by a folding line 9 running continuously in the transverse direction. A bottom 12 of the counter 13 mentioned is glued to the front part 10 of the top section.

Figure 2:
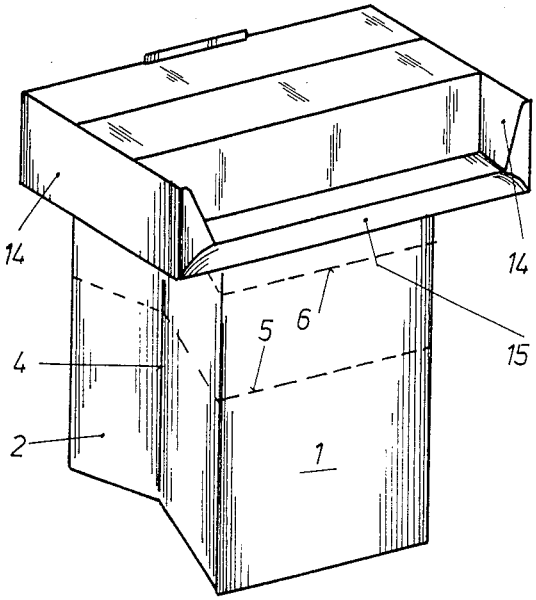
FIG. 2 shows the display stand according to FIG. 1 from an oblique perspective view from the front.

The counter consists of the bottom, two side walls 14 or upright and, in some cases, a front wall 15 or upright, which can however, as FIG. 2 shows in particular, be cut out; it also can be dispensed with entirely.

Figure 3:
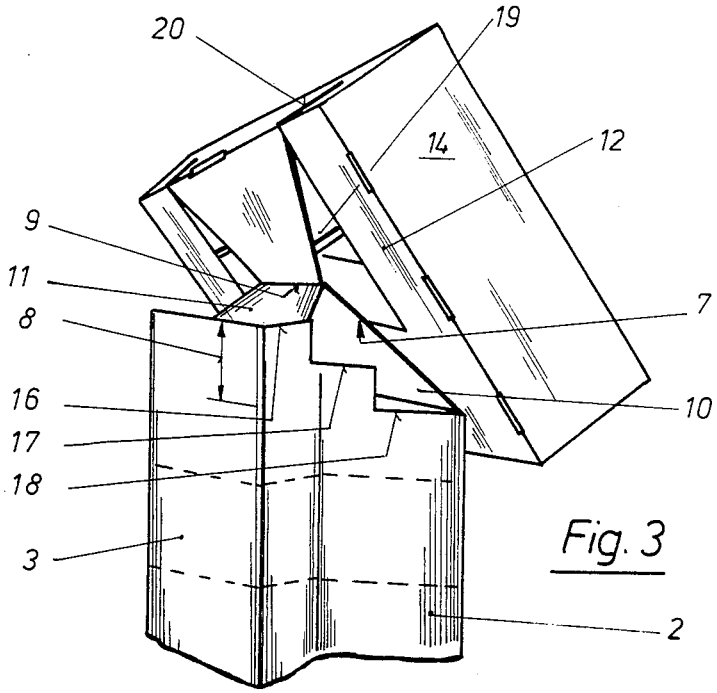
FIG. 3 shows the upper part of the display stand, in which the stepped extensions of the side walls of the base are just before entry in the counter, the view being looking at the bottom of the counter obliquely from below.

FIG. 3 shows in particular that the rear wall or rear upright 3 of the base is extended upwards by the distance 8. The adjoining part of the side walls 2 of the base is also correspondingly extended and thereby forms a top step 16. A middle step 17 adjoins thereto, and thereto in turn a front step 18. As already mentioned, the side walls can also be formed with two steps, four steps etc.

Punched clearances 19 are provided in the bottom 12 of the counter 13 and allow the steps 16, 17 of the side walls of the base to pass through during the assembly operation. In the rear wall of th counter, the punched clearances 19 turn into slits 20, which end at a specified distance underneath the top edge of the rear wall of the counter.

Figure 4:
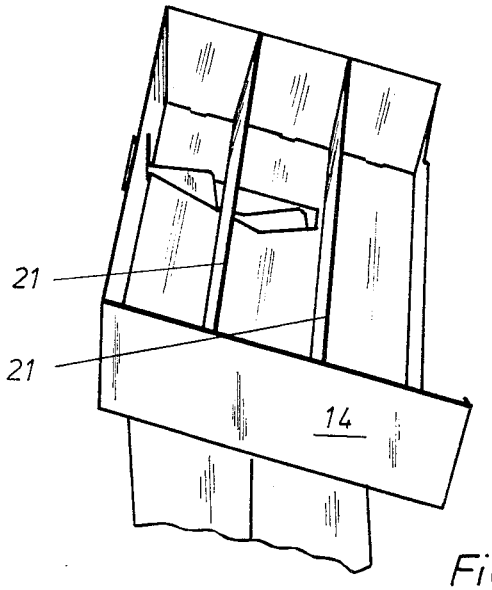
FIG. 4 shows, in a likewise oblique perspective view from above, the stepped extensions of the side walls of the base passed through the punched clearances in the bottom of the counter.
Figure 5:
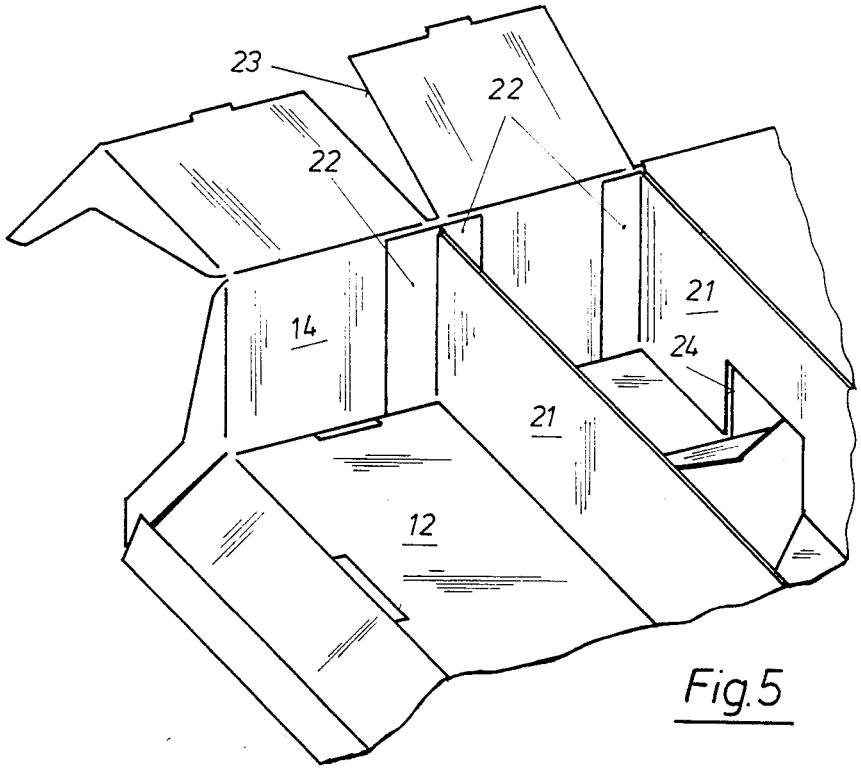
FIG. 5 shows the front part of one of the side walls of the counter in partially assembled position to illustrate fixing the ends of the dividers in the side walls.

The counter is subdivided into several compartments by means of dividers 21 which extend in the transverse direction. FIG. 4 shows in particular that one of the dividers in each case is located in front of each of the steps 16, 17. FIG. 5 reveals that the dividers 21 are two-ply and have at their ends retaining flaps 22 bent off at right angles. One of the plies of the side walls 14 has slits 23 in the region of the dividers 21. Thus, the card walls designed in this way allow the ends of the dividers 21 to be fixed well to the side walls 14 of the counter.

FIG. 5 also shows that the rearmost divider 21 has cut-outs 24 on its underside for the step 17 to pass through.

Flat blank sections or strips, which are somewhat smaller than the compartments created by the dividers 21, the side walls and the rear wall or front wall of the counter (FIG. 4 shows a total of three such compartments), are laid on the top edges of the steps 16, 17. The articles concerned are thus stacked up on these flat blank sections.

If the folded up base is assembled, the extensions or steps 16, 17 of the side walls pass through the punched clearances 19 in the bottom of the counter and the flat blank sections resting on these steps are raised together with the articles on them, so that the articles are displayed to the customer on a number of steps.

The rear wall, and in some cases, the front wall of the counter are also two-ply. One or more slits can therefore be provided in the rear wall of the counter, into which retaining tabs of a further blank can be inserted from above. This blank either stands vertically upwards on the rear wall and can be used as an advertising board and/or it can be swung forward, then acting in the manner of a cover and protecting the articles packed in the counter. In this case, this blank should be about the size of the basic outline of the counter.

What is claimed is:

1. A display stand made of folding material for displaying merchandise, comprises:

a tubular base having a front wall, a rear wall and two side walls, each of said two side walls having a longitudinal folding line running centrally therein, each said walll of said base so hingedly joining the adjacent said wall of said base by means of a longitudinal bending line that said base can be folded flat, and each said wall of said base having at least one transverse folding line therein;

a top section hingedly attached to said front wall and to said rear wall and having a folding line running parallel to the planes of said front wall and said rear wall, said top section folding line dividing said top section into a front part and a rear part;

a counter having a bottom, a rear upright and two side uprights for the reception and display of the merchandise said bottom being so hingingly attached to said top section, that when said base is folded flat along said side wall longitudinal folding lines and said longitudinal bending lines said bottom of said counter lies against said base, and wherein said flat folded base is assembled by swinging said counter in relation to said base;

said rear wall of said base being extended upwardly from said top section folding line which connects said rear wall to said top section, and each of said two side walls of said base having an upper edge which rises upwardly from said front wall to meet said upwardly extended rear wall such that at least one step is formed on each said upper edge of each of said two side walls;

said bottom of said counter having at least one clearance formed therein through which said at least one step passes;

at least one divider so positioned in said counter that compartments are defined by said two side uprights, said rear upright and said at least one divider, each said divider being positioned ahead of each said step which passes into said compartment through said clearance, and each said divider having two ends, each said end being connected to one of said two side uprights; and at least one strip resting upon said at least one step of each of said upper edges of said two side walls of said base.

2. A display stand as claimed in claim 1, wherein said side walls of said counter are folded two-ply on themselves and wherein said divider is two-ply such that said ends of said divider form retaining flaps bent at right angles relative to said divider, said flaps being received between the plies of said side walls.

3. A display stand as claimed in claim 1, wherein said clearances include cuts in said rear upright of said counter.

4. The display stands as claimed in claim 1, wherein said bottom of said counter is connected to said front part of said top section such that when said base is folded flat said bottom of said counter lies against said front wall of said base.

5. A display stand as claimed in claim 1, wherein said bottom of said counter is attached to said rear part of said top section such that when said base is folded flat said bottom of said counter lies against said rear wall of said base.

* * * * *

UNITED STATES PATENT AND TRADEMARK OFFICE

CERTIFICATE OF CORRECTION

PATENT NO. : 4,582,283

DATED : April 15, 1986

INVENTOR(S) : Paul Schmitt

It is certified that error appears in the above—identified patent and that said Letters Patent is hereby corrected as shown below:

Col. 1, line 65, delete "know" and substitute therefor --known--;

Col. 3, line 23, delete "by" and substitute therefor --be--;

Col. 3, lines 46 and 47, delete "or rear upright";

Col. 3, line 57, after "rear wall" insert --or rear upright--;

Col. 3, line 57, delete "th" and substitute therefor --the--; and,

Col. 4, line 35, delete "walll" and substitute therefor --wall--.

Signed and Sealed this

*Ninth* Day of *September 1986*

[SEAL]

*Attest:*

DONALD J. QUIGG

*Attesting Officer*

*Commissioner of Patents and Trademarks*